US007172471B2

(12) United States Patent
Bommersheim

(10) Patent No.: US 7,172,471 B2
(45) Date of Patent: Feb. 6, 2007

(54) ELECTRICAL HIGH-CURRENT CONTACT ELEMENT

(75) Inventor: Hermann Bommersheim, Silingen (DE)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 11/234,869

(22) Filed: Sep. 23, 2005

(65) Prior Publication Data

US 2006/0073741 A1 Apr. 6, 2006

Related U.S. Application Data

(63) Continuation of application No. PCT/DE2004/000588, filed on Mar. 23, 2004.

(30) Foreign Application Priority Data

Mar. 24, 2003 (DE) ..... 203 04 748

(51) Int. Cl.
*H01R 11/22* (2006.01)

(52) U.S. Cl. ..... 439/850; 439/884

(58) Field of Classification Search ..... 439/850, 439/884

See application file for complete search history.

(56) References Cited

U.S. PATENT DOCUMENTS 5,769,672 A * 6/1998 Flieger ..... 439/850
6,776,647 B1 * 8/2004 Herrmann et al. ..... 439/403
2001/0039139 A1 11/2001 Herrmann et al.

FOREIGN PATENT DOCUMENTS

| | | |
|---|---|---|
| DE | 20 51 228 | 4/1971 |
| DE | 37 31 625 | 3/1989 |
| DE | 199 21 769 | 11/2000 |

* cited by examiner

*Primary Examiner*—Truc Nguyen
(74) *Attorney, Agent, or Firm*—MacMillan, Sobanski & Todd, LLC

(57) ABSTRACT

The invention relates to an electrical high-current contact element essentially comprising a basic contact element made of metal exhibiting good conductivity and a steel spring, which is incorporated into a plug connector housing for the mounting of a high-current plug connector. The steel spring comprises two spring arms at a distance from one another, which are connected to one another by means of a U spring arm base. The contact arm is arranged in a manner reaching through the spring arm base between the spring arm and the spring arm. The high-current mating contact element is inserted into the mouthlike plug-in opening during the production of the plug connection, functional parts at plug connector housing and high-current mating plug connector opening the two spring arms and thus also the plug-in opening. In order to produce a high-current plug connection, the high-current plug connector is to be plugged into a high-current mating plug connector according to the invention with a high-current mating contact element.

19 Claims, 6 Drawing Sheets

ELECTRICAL HIGH-CURRENT CONTACT ELEMENT

CROSS REFERENCE TO RELATED APPLICATIONS

This application is a continuation of International Application No. PCT/DE2004/000588 filed Mar. 23, 2004, the disclosures of which are incorporated herein by reference, and which claimed priority to German Patent Application No. 203 04 748.6 filed Mar. 24, 2003, the disclosures of which are incorporated herein by reference.

BACKGROUND OF THE INVENTION

The invention relates to an electrical high-current contact element for high-current contact connection.

Customary high-current contact connections use screw joints or soldered joints for contact-connecting purposes.

DE 199 44 493 A1 discloses a plug connector for sheet conductors that is used to transmit normal current. It has a contact element housing with a contact element and a sheet carrier housing with a sheet conductor. The contact element is a metallic contact spring with a C-shaped curved spring arm and, in a lengthening of a curved spring arm, with a spring arm web having a knob. Contact lugs are situated at the end of a curved spring arm and at the end of the second curved spring arm or the beginning of the spring arm web. The sheet conductor is provided with a knob. When the sheet conductor housing with the sheet conductor is plugged into the contact element housing, the C-shaped curved spring arm is opened by means of the knob at the sheet conductor and the ramp-type knob at the spring arm web, so that the contact lugs do not touch one another and the sheet conductor can be inserted between the contact lugs at the C-shaped curved spring arm. In the further plug-in movement the C-shaped curved spring arm closes again as a result of the spring stress and the contact lugs produce the contact with the sheet conductor because the knob at the sheet conductor no longer actuates the knob at the spring arm web. Guide grooves and retention cams serve for guiding and fixing the sheet carrier housing in the contact element housing.

A contact element of this type is not suitable for high-current contacts.

BRIEF SUMMARY OF THE INVENTION

An object of the invention is to provide a high-current contact element and a plug connector which are suitable for high-current contact connection and, in conjunction with low required plug-in and withdrawal forces, enable reliable contact connection and also locking of the plug connector in a mating plug connector.

Other advantages of this invention will become apparent to those skilled in the art from the following detailed description of the preferred embodiment, when read in light of the accompanying drawings.

DETAILED DESCRIPTION OF THE INVENTION

Figure 1:
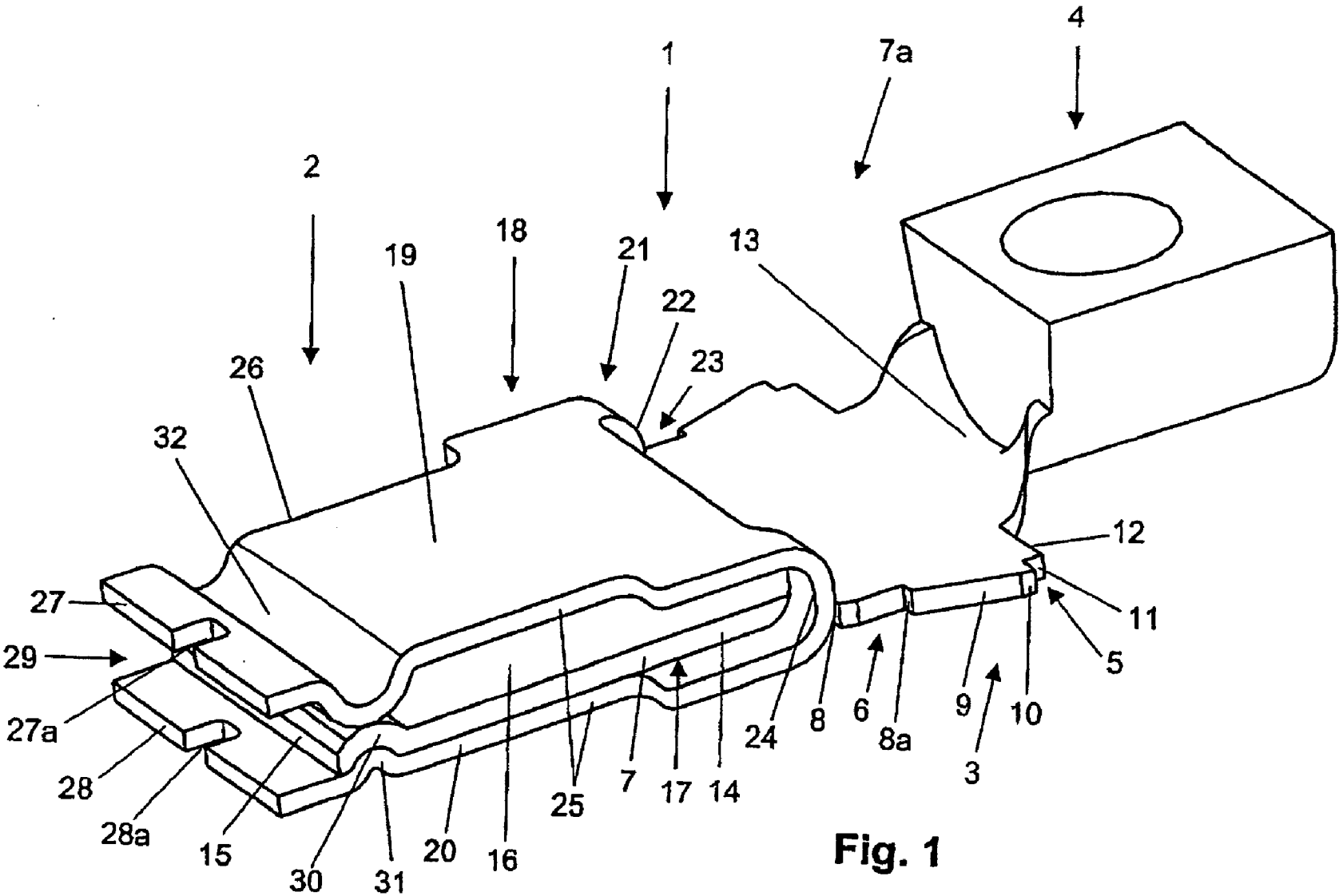
FIG. 1 shows a perspective view of a high-current contact element according to the invention.

The high-current contact element 1 according to the invention, in particular for transmitting currents e.g. in the range of 100 A to 700 A, such as are distributed e.g. in motor vehicle batteries with current distributors, essentially comprises a contact region 2, a transition region 3 and a connection region 4 (FIG. 1).

The connection region 4 serves, in a manner known per se, for connection to a current distributor or a current cable or the like. Its spatial form is not relevant to the invention and it is therefore not described in any greater detail.

The transition region 3 is expediently in plate form, preferably planar, there being adjacent in the transition from the connection region 4 an anchoring region 5 and, adjacent to the latter, a stop region 6. The stop region 6 merges with a plate-type contact arm 7.

The anchoring region 5 is wider than the stop region 6 and the latter is wider that the contact arm 7, there beginning in each case on both sides, in the transition from the contact arm 7 to the stop region 6, a stop edge 8 and, in the transition from the stop region 6 to the anchoring region 5, a widening bevel 9 with a further stop edge 8*a* of the anchoring region 5 that merges with a straight side edge 10 of the anchoring region 5. The purpose of the bevel 9 is explained further below (FIG. 1).

The straight side edge 10 merges with a corner 11 that has been stamped free, there being adjacent to said corner a rear edge 12 running at right angles to the side edge 10 and merging with a linking web 13. The purpose of this configuration is explained further below.

The contact arm 7 has the two longitudinal side edges 14 and the end edge 15 and also a top side 16 and an underside 17. A transverse bead 30 preferably extending from one longitudinal side edge 14 to the other longitudinal side edge 14 is shaped in the region of the end edge 15, the elevation of said bead being situated in the top side 16 and the depression of said bead being situated in the underside 17 (FIG. 1). The high-current contact element 1 thus has a basic contact element 7*a* essentially comprising the plate-type contact arm 7 with transition region 3 and connection region 4.

The contact region 2 of the basic contact element 7*a* is in two parts, the contact arm 7 forming one part and a U-shaped metal spring, in particular steel spring 18, forming the other part.

The steel spring 18 has the two spring arms 19, 20 spaced apart opposite one another and the U spring arm base 21 with a bottom wall 22.

The U spring arm base 21 is wider than the contact arm 7, there being introduced in the bottom wall 22 an elongated hole 23 extending transversely with respect to the longitudinal extent of the first spring arm 19 and the second spring arm 20, the length of said elongated hole corresponding to the width of the contact arm 7 and the contact arm 7 reaching through said elongated hole, so that it is situated between the first and second spring arms 19, 20.

The spring arms 19, 20 preferably have the same width as the contact arm 7. The steel spring 18 is only widened with respect to the region of the spring arm base 21, so that the elongated hole 23 can be shaped into the bottom wall. The widening may be stepped.

Spring arm base clips 24 of the spring arm base 21 which remain on account of the elongated hole 23 are placed against the stop edge 8 of the basic contact element 7*a*. The spring arms 19, 20 are made longer than the contact arm 7. They have the longitudinal side edges 25, 26 and the end edges 27, 28, which project beyond the end edge 15 of the contact arm 7 by a portion. In the region of the transverse bead 30 of the contact arm 7, an equidirectional bead 31 engaging into the bead 30 is introduced into the adjacent spring arm 20. A bead 32 is shaped into the spring arm 19 in a manner lying opposite the bead 30, said bead 32 extending toward the bead 30, the beads 30, 32 expediently touching one another (FIG. 1).

The spring arms 19, 20 thus engage over the contact spring arm 7 and clamp it in between the beads 31, 32, the beads 30, 32 forming a contact location in the form of a contact line. By means of the rear stop edge 8 and the engagement of the bead 31 into the bead 30, the steel spring 18 is spatially fixed at the basic contact element 7*a*.

The arms 7, 19, 20 expediently run parallel to one another, the contact spring arm 7 bearing on the spring arm 20. A U-shaped cutout 27*a*, 28*a* is in each case introduced in the transverse central region of the end edges 27, 28 of the spring arms 19, 20, the purpose of said cutout being explained further below.

Figure 3:
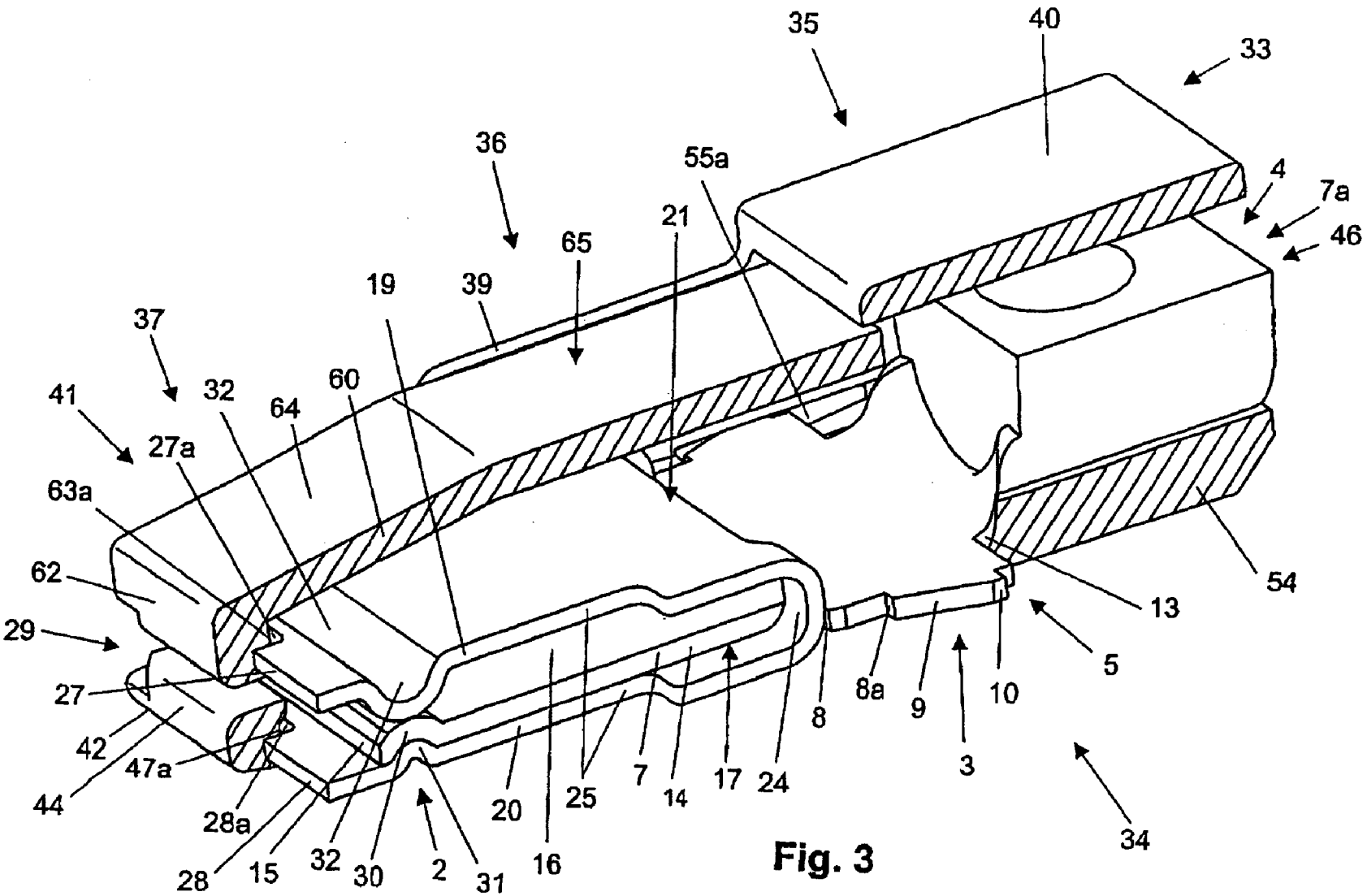
FIG. 3 shows a perspective view with a sectional longitudinal half of the plug connector housing of the plug connector according to FIG. 2 with a high-current contact element.

The beads 30, 31, 32 form a funnel-mouthlike plug-in opening 29, through which a contact prong of a mating contact element 79 can be inserted (FIGS. 1, 3).

Figure 5:
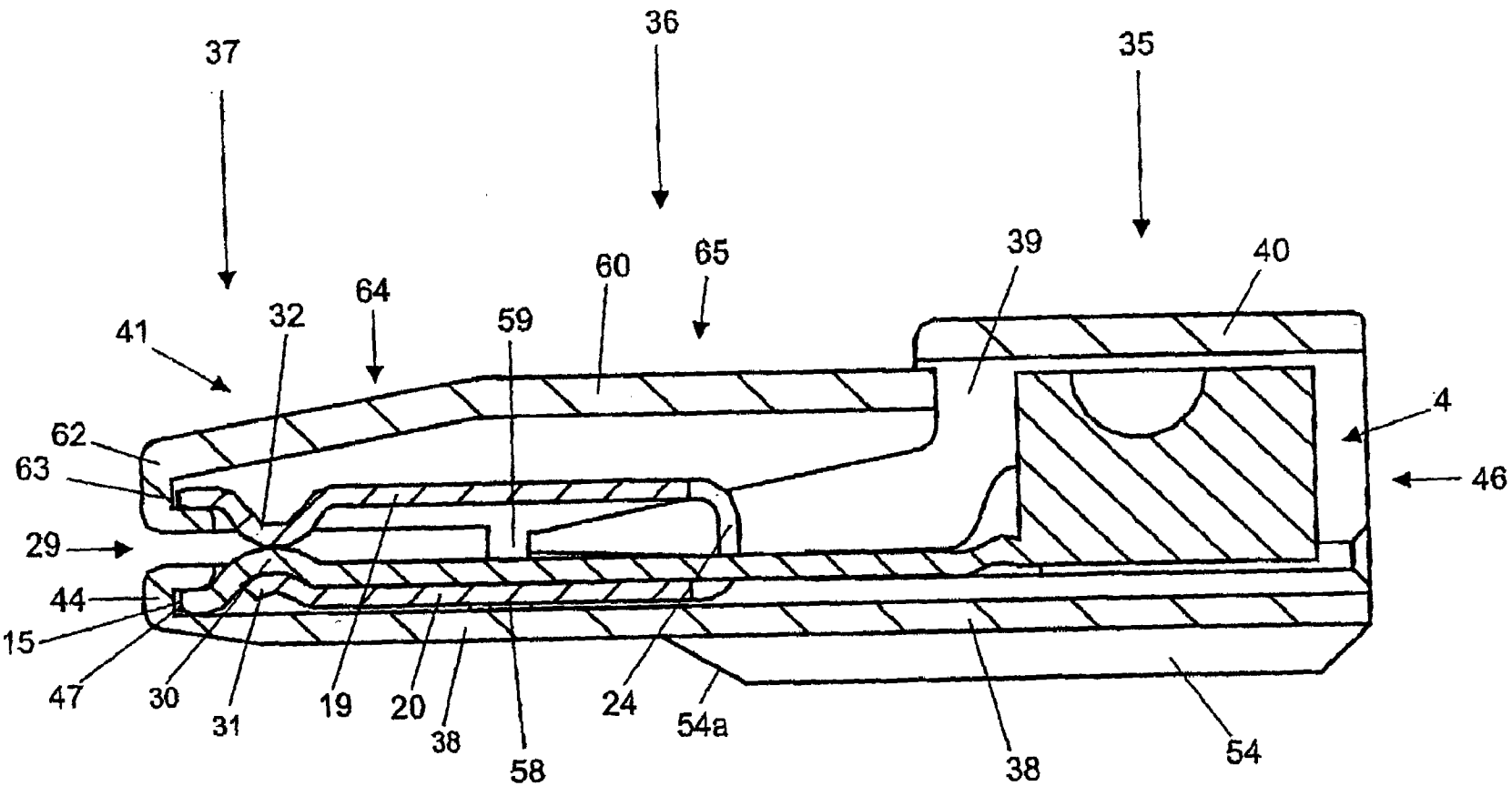
FIG. 5 shows a longitudinal section through a plug connector according to the invention in a second exemplary embodiment.

In a second exemplary embodiment, the contact arm 7 has the same length as the spring arm 19, so that the end edge 27 of the spring arm 19 and the end edge 15 of the contact arm 7 are flush. In this case, the spring arm 20 is made shorter than the spring arm 19 and the contact arm 7. The spring arm 19 and the contact arm 7 thus project beyond the spring arm 20 by a portion. The purpose of this embodiment is likewise explained further below (FIG. 5).

The contact element 1 according to the invention ensures, by means of the steel spring 18, high contact forces at the contact location and a high conductivity via the contact arm 7, which comprises metal exhibiting very good conductivity. Moreover, the mouth formation permits the possibility of opening the contact location prior to plugging or pulling the mating contact element 79 using external means of a mating plug connector.

The contact element 1 according to the invention is inserted in a plug connector housing 33, which results in a high-current plug connector 34. According to the invention, the plug connector housing 33 is intended to have functional parts which, during the plugging of a high-current mating plug connector, with the corresponding functional parts thereof, ensure a plugging force reduction or effect the opening of the contact location of the high-current contact element 1.

Figure 2:
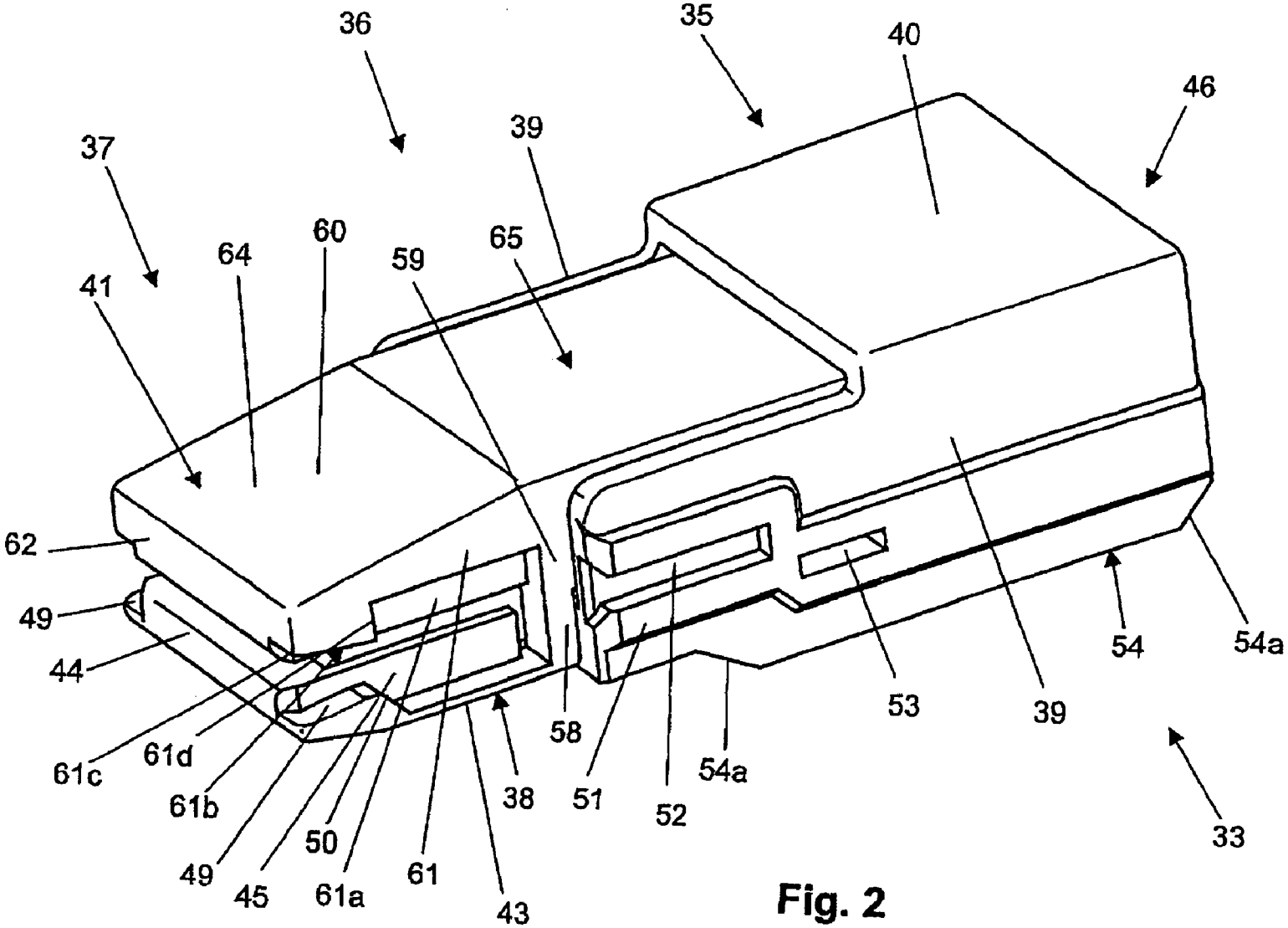
FIG. 2 shows a perspective view of a plug connector according to the invention.
Figure 4:
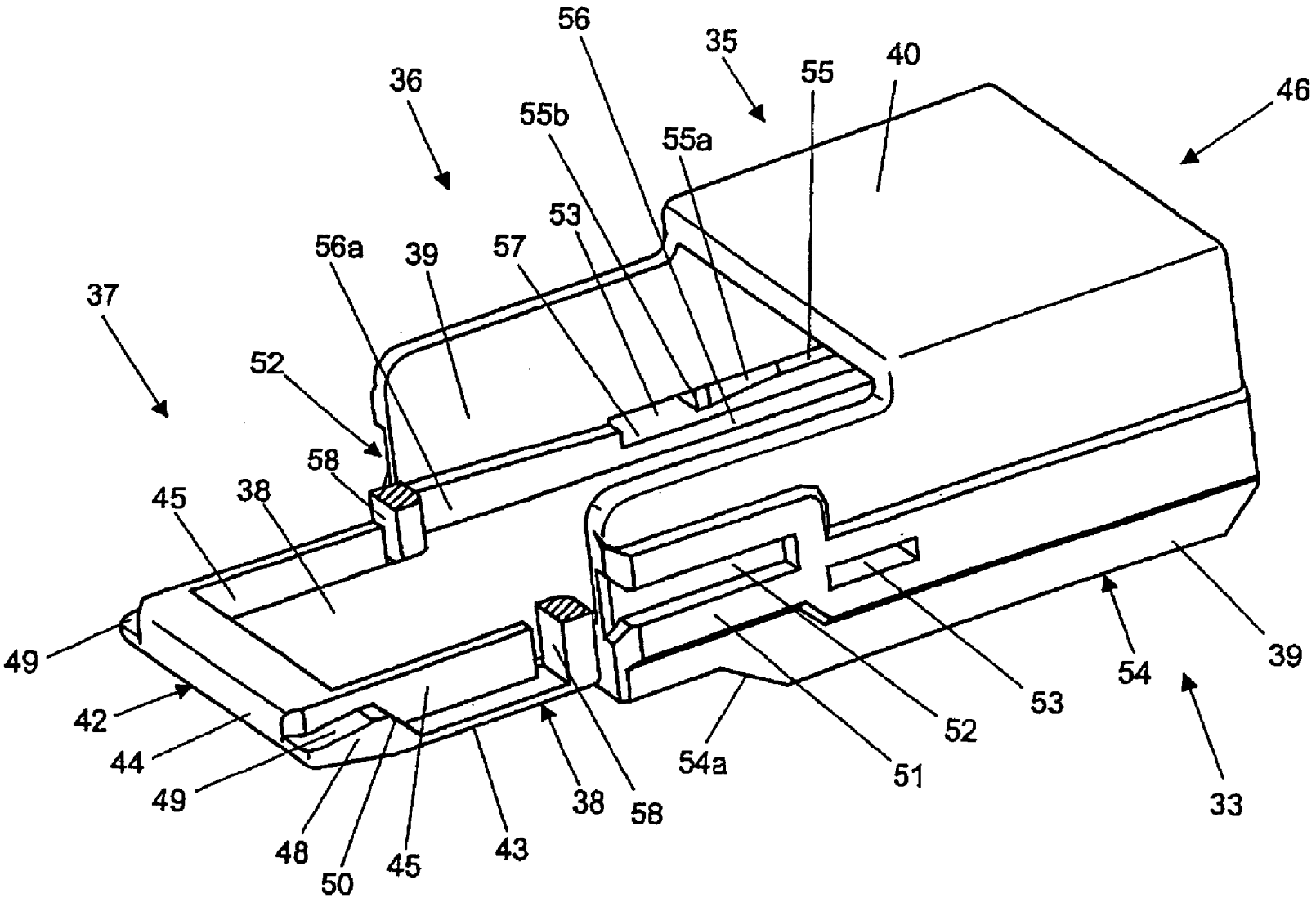
FIG. 4 shows a perspective view of the plug connector housing of the plug connector according to FIG. 2 without a lever arm.

The plug connector housing 33, preferably comprising plastic, is provided in its longitudinal extent with a back rectangular-tubular housing section 35 with a rear opening 46, a central U-shaped housing section 36 and a front plate-type housing bottom section 37 (FIGS. 2, 4). The connection region 4 and the linking region 13 of the high-current contact element 1 are mounted in the rectangular-tubular housing section 35, and the transition region 3, the stop region 6 and the anchoring region 5 and also a part of the contact region 2 are mounted in the U-shaped housing section 36. The plate-type housing bottom section 37 supports the remaining part of the contact region 2 (FIG. 3). The plug connector housing 33 has a bottom wall 38, two side walls 39, a cover wall 40 and a lever arm 41. The bottom wall 38 extends over all three housing sections 35, 36, 37. The housing section 36 is provided with the side walls 39 besides the bottom wall 38 and the cover wall 40 is additionally present in the housing section 35. The lever arm 41 extends as a continuation of the cover wall 40 into the housing sections 36, 37.

The bottom wall 38 has an end edge 42 and two longitudinal side edges 43 in the housing bottom section 37. On the top side of the bottom wall 38, an end wall 44 directed inward in an L-shaped manner in cross section is arranged at the end edge in the transverse direction. Situated on the longitudinal side are the wall webs 45, which have the height of the end wall 44 and which are arranged in a manner spaced apart laterally inward from the respective longitudinal side edge 43. On account of the L shape of the end wall 44, a groove 47 is produced with the bottom wall 38, said groove being open toward the back (FIG. 3). A web 47*a* is provided transversely centrally in the groove 47. Guide knobs 48 are situated at the end edge 42 on the top side of the bottom wall 38 in the corner region between the wall webs 45 and the longitudinal side edge 43, a front-side bevel 49 merging with a sloping steeper back bevel 50.

On the two side walls 39 in the housing section 36, there is shaped on the outer side in each case a U-shaped web 51 with the opening to the front side, so that a guide groove 52 is formed in a manner extending parallel to the longitudinal extent of the housing 33.

Moreover, a latching-in slot 53, which likewise extends parallel to the longitudinal extent of the housing 33, in a lengthening of the lower U limb of the web 51 is present in each side wall 39.

The underside of the bottom wall 38 is provided with three guide rails 54 extending in the longitudinal direction of the housing 33 in the region of the housing section 35 and also in a back part of the housing section 36. Two guide rails 54 are preferably positioned in a lengthening of the side wall 39 downward and one is positioned centrally on the underside (not visible). The guide rails 54 are provided with ramps 54*a* at the respective end (FIGS. 2, 4).

At a small distance above the bottom wall 38, a respective web 56 is integrally formed in one piece in the side walls 39 in the longitudinal direction on the inner side of the side walls 39, said web, in the rectangular-tubular housing section 35, approximately corresponding to the thickness of the lower spring arm 20 of the high-current contact element 1. The web 56 forms a wider bearing area for the guide grooves 55 extending in the side walls 39 from the plug-in opening 46 right into the second housing section 36. The guide grooves 55, which have a bevel 55*a* in their transition region to the U-shaped housing section 36, form latching edges 55*b* upon the transition into the latching-in slots 53. In a lengthening of the guide grooves 55 toward the front, the web 56 in the housing section 36 at each of the side walls 39 is embodied in stepped fashion in a thickened manner as web 56*a*. The end of the web 56*a* at the guide groove 55 is not abruptly right-angled, but rather made partially in the form of a beveling (FIG. 4).

The two-armed plate-type lever 41 has the front lever arm 64 and the back lever arm 65 and extends in the sections 36, 37 (FIGS. 2, 3). The lever 41 is mounted in the transition region between the housing section 36 and the housing bottom section 37 in rockerlike fashion on a short transverse support 58 located on the bottom wall 38 and a counter-transverse support 59 arranged on the lever 41. The supports 58, 59 are connected to one another. The connecting location may have the same material thickness as the supports 58, 59 (FIG. 2), but it may also have a constriction (not illustrated). There is a gap between the wall web 45 and the support 58. It is thus possible to achieve a rocking movement of the lever 41, for example by the application of force to the back end 65 of the lever 41. The lever 41 is U-shaped in cross section with a continuous cover wall 60, two side wall webs 61 and a front end wall 62. A transverse groove 63 with a transversely central web is formed in the end wall region of the end wall 62 that is C-shaped in cross section (FIG. 3). The side wall webs 61 have a jump toward the inner side (not visible) in the transition from the back lever arm 65 to the front lever arm 64 of the lever 41. In the front lever arm 64, there are provided on the outer side in the side wall 61 of the ramp 48, in a manner lying opposite in mirror-inverted fashion, a rectangular cutout 61*a* and a ramp-type guide knob or ramp 61*b* (FIG. 2) with a front sloping approach bevel 61*c* corresponding to the bevel 49 and a back vertical edge 61*d*.

For the assembly of the plug connector 34, the high-current contact element 1 is to be inserted into the plug connector housing 33 from the back. For this purpose, it is necessary previously, for the mounting of the high-current contact element 1, to insert the end edge 15 of the contact arm 7 into the elongated hole 23 of the steel spring 18 until the bead 30 bears on the bead 31 of the spring arm 20. Due to the spring force, the bead 30 is pressed onto the bead 31 of the spring arm 20 by the bead 32 at the spring arm 19 (FIGS. 1, 3). Afterward, the high-current contact element 1 is to be inserted with the end edges 27, 28 in front into the rear plug-in opening 46 of the plug connector housing 33 (FIG. 3). In this case, the high-current contact element 1, after the insertion of the contact arm 7, is supported and guided by the straight side edge 10 on the side walls 39 by virtue of said side edge engaging into the guide grooves 55 in the side walls 39 (FIG. 3). The introduction is effected as far as until the end edge 28 of the spring arm 20 or the end edge 15 of the contact arm 7 in the second exemplary embodiment (FIG. 5) engages into the transverse groove 47 on the end wall 44 of the bottom wall 38 of the first housing section 37. On account of the cutout 28*a* on the end side 28 of the spring arm 20 or of an analogous cutout in the second exemplary embodiment, a complete insertion movement into the transverse groove 47 is possible by virtue of the web 47*a* in the transverse groove 47 engaging into the cutout 28*a*. The spring arm 19 is analogously inserted into the transverse groove 63 on the end wall 62 of the lever 41, here as well a web 63*a* in the transverse groove 63 engaging into the cutout 27*a* (FIGS. 3, 5).

The end edge regions of the end edges 27, 28 of the spring arms 19, 20 are thus enclosed by the transverse grooves 47, 63, in which case the end walls 44, 62 may serve as insertion boundaries. The stop edges 8*a* at the transition region 3 function as a further insertion boundary. These abut the web 56*a*, the widening bevel 9 being shaped complementarily with respect to a beveling 55*a* between the web 56 and the guide grove 55. The transition region 3 in the region of the side edge 10 and bevel 9 bears on the bearing area 57 and in the guide groove 55. The side edge 10 engages into the latching-in slot 53 of the side walls 39 for fixing or locking purposes. The distance between the guide groove 55 and the bottom wall 38 corresponds to the thickness of the lower spring arm 20, since the contact arm 7 is mounted at a constant distance from the bottom wall 38 and the spring arm 20 is situated between contact arm 7 and bottom wall 38 (FIG. 3).

In a second embodiment, the lengthened contact arm 7 engages with the end edge 15 into the transverse groove 47 on the end wall 44, the spring arm 20 being shortened, that is to say that there is no distance between the bead 31 and the end edge 28 on the spring arm 20. A corresponding cutout for the web 47*a* in the transverse groove 47 is present on the end edge 15 of the contact arm 7 (FIG. 3).

The high-current mating plug connector housing 66 is preferably U-shaped in cross section and preferably comprises plastic. It is provided with a bottom wall 67, two side walls 68 and a rear wall 69 and also an insertion opening 73 (FIG. 5). In the central region of their longitudinal extent, the side walls 68 are provided with an inwardly directed step 70 running from top to bottom. In this case, the clearance between the side walls 68 in the back region 72 behind the step 70 corresponds to the width of the bottom wall 38 in the housing bottom section 37 of the plug connector housing 33 and the clearance between the side walls 68 in the front region 71 in front of the step 70 corresponds to the width of the plug connector housing 33 at the side walls 39. A plug-in slot 74 in the transverse direction is formed in the rear wall 69.

In the bottom wall 67, there are present in the region of the plug-in opening 73 between the two side walls 68 three guide grooves 75 in the longitudinal direction approximately in the first quarter of the front region 71, there being two guide grooves 75 respectively at the two side walls 68 and a further guide groove 75 being positioned centrally, for example, between the two side walls 68.

Figure 6:
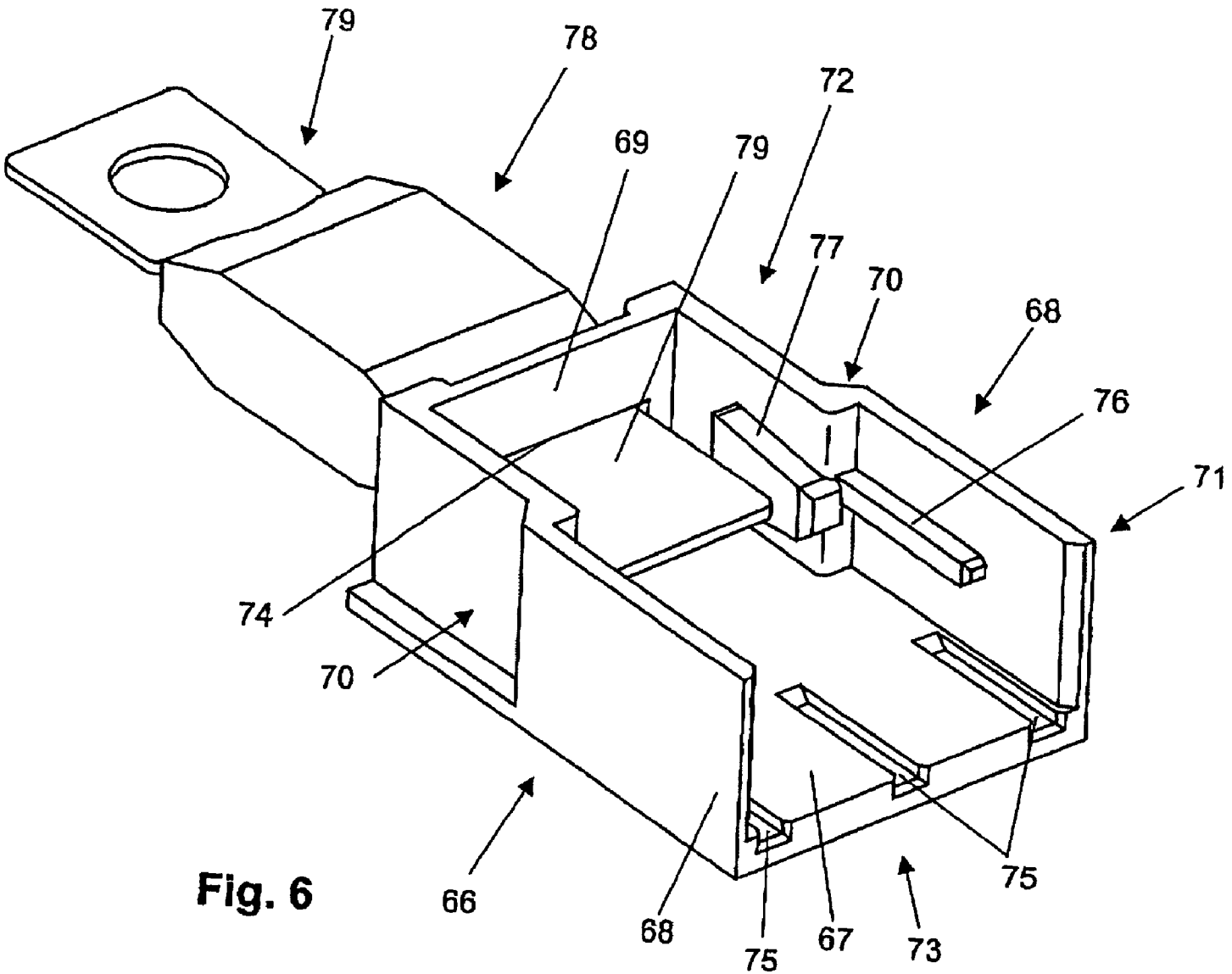
FIG. 6 shows a perspective view of a mating plug connector according to the invention with a high-current mating contact element.

On the inner side of the side walls 68, a guide web 76 of constant thickness extending parallel to the bottom wall 67 is formed approximately at half the height of the step 70 almost up to the plug-in opening 73 (FIG. 6). Subsequent to the narrow guide web 76 toward the back, that is to say behind the step 70, an opening wedge 77 expanding toward the back is arranged on the inner side of the side walls 68 in the back region 72 (FIG. 6).

The contact prong 79 depicted is the high-current mating contact element of the exemplary embodiment. It is part of a protection element 78 between the two contact plates (FIG. 6). The contact prong 79 reaches through the plug-in slot 74 and extends right into the region of the step 70.

The plug connector housing 33 with the high-current contact element 1 is inserted into the insertion opening 73 of the mating plug connector housing 66.

For producing the plug connection, the underside of the bottom wall 38 in the region of the housing bottom section 37 of the plug connector housing 33 is to be placed onto the bottom wall 67 of the mating plug connector housing 66 between the two side walls 68 and be inserted in the direction of the rear wall 69. With the insertion movement, the three guide rails 54 on the underside of the bottom wall 38 of the plug connector housing 33 are inserted into the three guide grooves 75 in the bottom wall 67 of the mating plug connector housing 66 between the side walls 68 in the front region 71, which serves for guiding the plug connector housing 33 in the mating plug connector housing 66. In this case, the height of the guide rails 54 is greater than the depth of the guide grooves 75, so that in the insertion movement, with the engagement of the guide rails 54 into the guide grooves 75, the plug connector housing 33 is raised continuously on account of the ramps 54*a* that are additionally present. With this raising process, the plug connector housing 33 is brought to the corresponding height in order that the guide webs 76 on the side walls 68 can engage into the guide groove 52 of the U-shaped web 51 at the side walls 39 of the plug connector housing 33. In the further insertion movement, the two guide wedges 77 on the side walls 68 of the mating plug connector housing 66 slide into the interspace between the guide knobs 48 on the bottom wall 38 of the plug connector housing 33 and the guide knobs 61 at the lever arm 41. During the insertion movement, force is exerted on the guide knobs 48, 61*b*, in particular the guide knob 61*b* on the lever arm 64, so that the lever arm 64 is pivoted counter to the spring force of the steel spring 18. The counterforce of the spring arm 20 is taken up by the guide knob 48, in particular, which bears on the guide wedge 77. The spring arm 19 of the steel spring 18 is thus raised. A plug-in slot opens between the bead 31 of the contact arm 7 and the bead 32 of the spring arm 19, through which the contact plate 79 slides without resistance. On account of the small gradient of the guide wedge 77, it is advantageous that only a small force is required for inserting the plug connector housing 33 into the mating plug connector housing 66. With the further process of insertion and the pivoting up of the front lever arm 64, the culmination of the guide knob 61*b* and the back end of the guide wedge 77 is attained. After the guide knob 61*b* crosses the guide wedge 77, the guide wedge 77 is no longer in the way of the guide knobs 48, 61*b*. As a result, no counterforce is exerted on the guide knobs 48, 61*b* and the spring force of the steel spring 18 causes the front lever arm 64 to snap together. The mating contact element 79 is thus clamped in between the bead 32 of the spring arm 19 and the bead 31 of the contact arm 7. The electrical contact is thus produced in the form of a contact line between the contact arm 7 and the mating contact element 79. At the lever arm 41, the cutout 61*a* is arranged after the guide knob 61*b*, the transition between the guide knob 61*b* and the cutout 61*a* not being beveled, that is to say being effected at right angles with the vertical edge 61*d*. The end of the guide wedge 77 engages into said cutout 61*a* and a withdrawal of the plug connector housing 33 in the mating plug connector housing 66 is precluded. This is possible because the cutout 61*a* is shaped in rectangular fashion, so that the guide wedge 77 meets a vertical edge 61*d* as boundary wall. The spring loading of the lever 41 by the steel spring 18 and the bottom wall 38 corresponds to an arrangement like a clothes peg. The steel spring 18 has a synergistic effect: it provides the contact force between the beads 31, 32 and loads the lever 41 for engaging the guide wedge 77 into the cutout 61*a* for locking purposes.

In order to cancel the electrical plug connection according to the invention, it is necessary to press onto the top side of the back lever arm 65, so that the lever arm 64 is raised counter to the spring force of the steel spring 18. In this case, the cutout 61*a* is lifted out of the guide web 71, the locking is thus released and the plug connector housing 33 can be withdrawn from the mating plug connector housing 66. The raising of the lever arm 64 releases the contact prong 79, so that withdrawing the contact prong 79 does not require any force.

The present electrical plug connection according to the invention makes it possible, in a simple manner, during the insertion of the plug connector housing into the mating plug connector housing, to produce an electrical contact for a high-current contact connection between the high-current contact element in the plug connector housing and the high-current mating contact element in the mating plug connector housing, only very small plug-in forces being required.

After the plug-in operation, the plug connector housing is automatically locked in the mating plug connector housing. This locking is released simply by applying a compressive force to the back lever arm of the plug connector housing. The mating plug connector housing may also be closed and have a cover wall.

In an embodiment of the invention, a high-current plug connector is provided wherein the side walls (61) have a step inward in the transition from the lever arm (65) to the lever arm (64).

In an embodiment of the invention, a high-current plug connector is provided wherein the plug connector housing (33), preferably comprising plastic, is provided with a back rectangular-tubular housing section (35) with a rear plug-in opening (46), a central U-shaped housing section (36) and a front plate-type housing bottom section (37), a bottom wall (38) extending in all three housing sections (35, 36, 37), and the housing sections (35, 36) additionally having the side walls (39) and the housing section (35) additionally having the cover wall (40), and the lever (41) extending in the manner of a lengthening of the cover wall (40) in the housing sections (36, 37).

In an embodiment of the invention, a high-current plug connector is provided wherein there is arranged on the top side of the bottom wall (38) the transverse direction of an end wall (44), which preferably terminates flush with an end edge (42), and in the longitudinal direction there is arranged a side wall (45), which preferably terminates in non-flush fashion at a distance from a longitudinal side edge (43), the end wall (44) preferably being wider than the end wall (45).

In an embodiment of the invention, a high-current plug connector is provided wherein the transverse groove (47) is present in the end wall (44) between the side walls (45), which transverse groove is directed toward the back with respect to the plug-in opening (46), and preferably has a web (47*a*) centrally.

In an embodiment of the invention, a high-current plug connector is provided wherein the free ends of the spring arms (19, 20) and/or of the contact arm (7) are mounted in transverse grooves (47, 63) of the end regions of the walls.

In an embodiment of the invention, a high-current plug connector is provided wherein the cutout (28*a*) engages into a web (47*a*) in the transverse groove (47) and the cutout (27*a*) engages into a web (63*a*) in the transverse groove (63).

In an embodiment of the invention, a high-current plug connector is provided wherein the plug-in opening (29) can be opened with functional parts, in particular a guide part (77), so that, on account of the connection to the spring arm (19), when the front lever arm (64) is moved, the spring arm (19) is taken along, thereby giving rise to an opening or distance between the bead (32) of the spring arm (19) and the bead (31) of the spring arm (20) or the bead (30) of the contact arm (7).

In an embodiment of the invention, a high-current plug connector is provided wherein there are arranged on the top side of the bottom wall (38) in the corner region, in a lengthening of the end wall (44), guide knobs (48) for opening the plug-in opening (29) with functional parts, in particular a guide wedge (77), a front top side (49) preferably having a smaller gradient than the back top side (50) in order that the top side (49) preferably bears in planar fashion on the functional parts.

In an embodiment of the invention, a high-current plug connector is provided wherein there is present in the lever arm (64), in the side walls (61), a rectangular cutout (61*a*) and, in the corner region, a ramp-type guide knob (61*b*) with a front falling run-off bevel (61*c*) and a back vertical edge (61*d*), the guide knob (61*b*) serving for opening the plug-in opening (29), and the cutout (61*a*) functioning for locking the high-current plug connector with functional parts, in particular a guide wedge (77), in a high-current mating plug connector.

In an embodiment of the invention, a high-current plug connector is provided wherein a guide groove (52) is formed on the two side walls (39) on the outer side preferably in the housing section (36), a U-shaped web (51) shaping the guide groove (52).

In an embodiment of the invention, a high-current plug connector is provided wherein a latching-in slot (53) extending parallel to the longitudinal extent of the housing (33) is present on the two side walls, preferably in the housing section (36).

In an embodiment of the invention, a high-current plug connector is provided wherein there are arranged on the underside of the bottom wall (38) three guide rails (54) with ramps (54*a*) at the respective end, for engaging in guide grooves (75).

In an embodiment of the invention, a high-current plug connector is provided wherein guide grooves (55) for guiding the side edge (10) of the high-current contact element (1) are shaped on the two side walls (39) on the inner side in the longitudinal direction at a small constant distance above the bottom wall (38), said guide grooves reaching from the plug-in opening (46) right into the housing section (36).

In an embodiment of the invention, a high-current plug connector is provided wherein a web (56, 56*a*) is formed on the two side walls (39) on the inner side in a lengthening of the guide grooves (55), which web reaches as far as the bottom wall (38), and a bearing area (57) is formed in the region of the latching-in slot (53) at the level of the guide groove (55), the web (56*a*) serving as insertion boundary for the stop edge (8*a*) and bearing on the bearing area (57) of the anchoring region (5).

In an embodiment of the invention, an electrical high-current mating plug connector for a high-current plug connector is provided wherein a mating plug connector housing (66), in which a mating contact element (79) is mounted and which has side walls (68), on the inner areas of which are arranged guide elements (76, 77) which, when the housings (33, 66) are plugged together, interact with the guide knobs (48, 61*b*) of the plug connector housing (33) for the purpose of opening the mouthlike plug-in opening (29) of the high-current contact element (1) by means of the lever arm (64).

In an embodiment of the invention, an electrical high-current mating plug connector for a high-current plug connector is provided wherein the mating plug connector housing (66), preferably made of plastic, has a bottom wall (67), two side walls (68), a rear wall (69) and a plug-in opening (73).

In an embodiment of the invention, an electrical high-current mating plug connector for a high-current plug connector is provided wherein the side walls (68), in the central region in longitudinal extent, is provided with a step (70) oriented perpendicularly to the walls (68), as a result of which the clearance between the side walls (68) in a back region (72) corresponds to the width of the bottom wall (38) and the clearance between side walls (68) in a front region (71) corresponds to the width of the plug connector housing (33) at the side walls (39).

In an embodiment of the invention, an electrical high-current mating plug connector for a high-current plug connector is provided wherein a plug-in slot (74) is formed in the transverse direction in the rear wall (69), a mating contact element (79) reaching through said slot.

In an embodiment of the invention, an electrical high-current mating plug connector for a high-current plug connector is provided wherein at least one, preferably three, guide grooves (75) are present in the front region in the longitudinal direction beginning at the front side of the bottom wall (67) between the two side walls (68), the guide rails (54) engaging into said guide groove(s).

In an embodiment of the invention, an electrical high-current mating plug connector for a high-current plug connector is provided wherein the plug connector housing (33) can be introduced with the housing section (37) firstly into the mating plug connector housing (66), so that the guide rails (54) engage into the guide grooves (75), the height of the guide rails (54) preferably being slightly greater than the depth of the guide grooves (75), so that the plug connector housing (33) can be raised during insertion, preferably slowly on account of the ramps (54*a*), at the guide rails (54).

In an embodiment of the invention, an electrical high-current mating plug connector for a high-current plug connector is provided wherein a guide web (76) and a guide wedge (77) are in each case present on the two side walls (68) on the inner side in the front region (71).

In an embodiment of the invention, an electrical high-current mating plug connector for a high-current plug connector is provided wherein the guide web (76) on the mating plug connector housing (66) engages into the U-shaped web (51) on the side walls (39) of the plug connector housing (33) when the plug connector housing (33) is inserted into the front region (71).

In an embodiment of the invention, an electrical high-current mating plug connector for a high-current plug connector is provided wherein the two guide wedges (77) on the mating plug connector housing (66), when the plug connector housing (33) is inserted into the front region (71), exert a compressive force on the guide knob (61*b*) at the lever arm (64) and the guide knob (48) at the bottom wall (38) counter to the spring force of the steel spring (18) so that the lever arm (64) can be raised.

In an embodiment of the invention, an electrical high-current mating plug connector for a high-current plug connector is provided wherein it is possible to insert the mating contact element (79) during the insertion of the plug connector housing (33) into the front region (71) between the bead (32) and the bead (31) with the steel spring (18) having been opened.

In an embodiment of the invention, an electrical high-current mating plug connector for a high-current plug connector is provided wherein during the insertion movement of the plug connector housing (33) into the front region (71), after crossing the knobs (48, 61*b*) at the guide wedge (77), no more force is applied to the knobs (48, 61*b*), so that the two spring arms (19, 20) and the lever arm (64) fold together on account of the spring force of the steel spring (18).

In an embodiment of the invention, an electrical high-current mating plug connector for a high-current plug connector is provided wherein a small expenditure of force is required for opening the steel spring (18) on account of the small spreading of the guide wedge (77) when the plug connector housing (33) is plugged into the front region (71).

In an embodiment of the invention, an electrical high-current mating plug connector for a high-current plug connector is provided wherein on account of the spring force of the steel spring (18), the mating contact element (79) is clamped in between the bead (30) of the contact arm (7) and the bead (32) of the steel spring (18), and it is thereby possible to produce an electrical contact between the mating contact element (79) and the connection region (4) of the basic contact element (7*a*), in particular by means of a current line.

In an embodiment of the invention, an electrical high-current mating plug connector for a high-current plug connector is provided wherein the cutouts (61*a*) at the lever arm (64) engage in the guide wedge (77) after the folding-together process, so that the guide wedge (77) is present at a vertical back edge (61*d*) of the cutout (61*a*) and the plug connector housing (33) can thereby be locked in the mating plug connector housing (66).

In an embodiment of the invention, an electrical high-current mating plug connector for a high-current plug connector is provided wherein the front lever arm (64) is raised by the application of a force to the back lever arm (65), so that the cutout (61*a*) does not engage into the guide wedge (77) and, as a result, the guide wedge (77) is not present at the vertical back edge (61*d*) of the cutout (61*a*), as a result of which the locking of the plug connector housing (33) in the mating plug connector housing (66) is released.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. An electrical high-current contact element comprising:

a basic contact element having a plate-type contact arm, a transition region, a stop region, a linking web, a connection region for the connection of a heavy-current element, the transition region having an anchoring region and a narrower stop region, such that the stop region adjoins the contact arm and is wider than the contact arm, the linking web connecting the anchoring region to the connection region; and a spring having a first spring arm spaced apart from a second spring arm, the spring arms being substantially in plate form and connected to one another by a U-shaped spring arm base.

2. The high-current contact element as claimed in claim 1, wherein the contact arm defines a first plane, the first spring arm defines a second plane, and the second spring arm defines a third plane such that the first plane of the contact arm, the second plane of the first spring arm, and the third plane of the second spring arm are substantially parallel.

3. The high-current contact element as claimed in claim 1, wherein the contact arm and the transition and stop regions are in plate form and define a plate plane.

4. The high-current contact element as claimed in claim 1, wherein the connection region can be connected to one of a current distributor and a current cable.

5. An electrical high-current contact element comprising:

a basic contact element having a plate-type contact arm, a transition region, a stop region, a linking web and a connection region for the connection of a heavy-current element, the contact arm having an end edge, two longitudinal side edges, a top side, an underside, and a rear edge, and a stop edge between the end edge and the rear edge, a transverse bead extending from one longitudinal side edge to the other longitudinal side edge and shaped into the contact arm in the region of the end edge, the elevation of the transverse bead extending outward of the top side and the depression of the transverse bead formed in the underside; and a spring having a first spring arm spaced apart from a second spring arm, the spring arms being substantially in plate form and connected to one another by a U-shaped spring arm base, the contact arm extending through the spring arm base between the first spring arm and the second spring arm.

6. The high-current contact element as claimed in claim 5, wherein the rear edge is adjacent to a straight side edge at right angles, the rear edge merging with the linking web.

7. The high-current contact element as claimed in claim 5, wherein the U-shaped spring arm base includes a bottom wall, having an elongated hole, the contact arm extending through the elongated hole.

8. The high-current contact element as claimed in claim 5, wherein a U-shaped cutout is formed in a transverse central region of end edges of the spring arms.

9. The high-current contact element as claimed in claim 7, wherein the stop edge abuts the U-shaped spring arm base.

10. An electrical high-current contact element comprising:

a basic contact element having a plate-type contact arm, a transition region, a stop region, a linking web and a connection region for the connection of a heavy-current element, a first transverse bead being formed in the contact arm; and a spring having a first spring arm spaced apart from a second spring arm, the spring arms being substantially in plate form and connected to one another by a U-shaped spring arm base, the contact arm extending through the spring arm base between the first spring arm and the second spring arm, the first and second spring arms being longer than the contact arm, and a second transverse bead being formed in the second spring arm and disposed in the depression of the first transverse bead formed in the contact arm.

11. The high-current contact element as claimed in claim 10, wherein a third transverse bead is formed in the first spring arm, the third transverse bead extending outward of the first spring arm such that it contacts the first transverse bead and defines a contact line.

12. The high-current contact element as claimed in claim 11, wherein the spring arms clamp the contact arm between the second and third beads.

13. The high-current contact element as claimed in claim 12, wherein the spring is spatially fixed by a stop edge of the stop region of the contact element and the engagement of the second transverse bead into the first transverse bead.

14. The high-current contact element as claimed in claim 11, wherein end edges of the spring arms are spaced apart to define a mouthlike plug-in opening through which a mating contact element can be inserted.

15. An electrical high-current contact element comprising:

a basic contact element having a plate-type contact arm, a transition region, a stop region, a linking web and a connection region for the connection of a heavy-current element; and a spring having a first spring arm spaced apart from a second spring arm, the spring arms being substantially in plate form and connected to one another by a U-shaped spring arm base, the contact arm extending through the spring arm base between the first spring arm and the second spring arm, the contact arm and the first spring arm having the same length, and the second spring arm having a smaller length than the contact arm and the first spring arm.

16. The high-current plug connector as claimed in claim 15, wherein the lever is mounted pivotably on both sides and centrally at the end of the side walls between a housing section and a housing bottom section on an integrally formed support with an integrally formed counter-support between the lever arms of the lever.

17. The high-current plug connector as claimed in claim 16, wherein the support and the counter support are connected in one piece.

18. The high-current plug connector as claimed in claim 16, wherein the lever is U-shaped in cross section, with a continuous cover wall, two side walls and an end wall, a transverse groove with a transversely central web being formed in the end wall.

19. An electrical high-current plug connector comprising:

a high-current contact element, the contact element including:

a basic contact element having a plate-type contact arm, a transition region, a stop region, a linking web and a connection region for the connection of a heavy-current element; and a spring having a first spring arm spaced apart from a second spring arm, the spring arms being substantially in plate form and connected to one another by a U-shaped spring arm base, the contact arm extending through the spring arm base between the first spring arm and the second spring arm; and a plug connector housing having side walls, the high-current contact element being mounted in the housing, a wall being formed as a pivotable two-armed lever mounted in rockerlike fashion and extending in the longitudinal direction, a back lever arm and a front lever arm, one lever arm defining an actuating lever, and the other lever arm levering open a plug-in opening and acting on the plug-in opening end of one of the spring arm and the contact arm.

* * * * *